US010280691B2

(12) United States Patent
Wendt et al.

(10) Patent No.: US 10,280,691 B2
(45) Date of Patent: May 7, 2019

(54) EARTH-BORING BIT

(71) Applicants: Jacob Wendt, Decatur, TX (US); Neal Bowden, Weatherford, TX (US)

(72) Inventors: Jacob Wendt, Decatur, TX (US); Neal Bowden, Weatherford, TX (US)

(73) Assignee: Klear Drilling Technologies LP, Decatur, TX (US)

( * ) Notice: Subject to any disclaimer, the term of this patent is extended or adjusted under 35 U.S.C. 154(b) by 95 days.

(21) Appl. No.: 15/608,528

(22) Filed: May 30, 2017

(65) Prior Publication Data

US 2018/0347283 A1 Dec. 6, 2018

(51) Int. Cl.

| | |
|---|---|
| ***E21B 10/60*** | (2006.01) |
| ***E21B 10/61*** | (2006.01) |
| ***E21B 10/43*** | (2006.01) |
| ***E21B 10/42*** | (2006.01) |

(52) U.S. Cl.

CPC ..... *E21B 10/602* (2013.01); *E21B 10/43* (2013.01); *E21B 10/61* (2013.01); *E21B 2010/425* (2013.01); *E21B 2010/607* (2013.01)

(58) Field of Classification Search

CPC ..... E21B 10/602; E21B 10/43; E21B 10/61; E21B 2010/607; E21B 2010/425; E21B 10/42

See application file for complete search history.

(56) References Cited

U.S. PATENT DOCUMENTS

| | | | | |
|---|---|---|---|---|
| 5,901,797 | A | 5/1999 | Hansen et al. | |
| 7,819,208 | B2 | 10/2010 | Pessier et al. | |
| 8,020,639 | B2 * | 9/2011 | Wells | E21B 10/602 175/340 |
| 2010/0126771 | A1 | 5/2010 | Entchev et al. | |
| 2010/0270078 | A1 | 10/2010 | Wells et al. | |
| 2013/0068525 | A1 | 3/2013 | DiGiovanni | |
| 2014/0332286 | A1 | 11/2014 | Murdock et al. | |

OTHER PUBLICATIONS

International Search Report and Written Opinion of International Searching Authority dated Aug. 24, 2018 from counterpart application PCT/US18/34918.

* cited by examiner

*Primary Examiner* — Wei Wang
(74) *Attorney, Agent, or Firm* — James E. Walton

(57) ABSTRACT

An earth-boring bit includes a bit body threaded at its upper extent for connection to a drill string and a plurality of blades on the bit body, each blade having a leading edge and a trailing edge. A plurality of cutting elements is arranged on the leading edge of each blade and a junk slot is defined between pairs of adjacent blades. A surface texture may be formed on the surface of the junk slot, the surface texture being selected to alter a flow of drilling fluid through the junk slot. At least one milling element may extend at least partially across the junk slot between the trailing edge and leading edge of adjacent blades, wherein flow of cuttings generated by the cutting elements is impeded until the cuttings are disintegrated to a selected size.

12 Claims, 10 Drawing Sheets

EARTH-BORING BIT

BACKGROUND

1. Field of the Invention

The present application relates generally to improvements in earth-boring bits and specifically to improvements in earth-boring bits of the fixed-cutter variety.

2. Description of Related Art

Rotary earth-boring bits are used to drill wells or boreholes for hydrocarbon extraction, geothermal energy extraction, waste disposal, and to make passages in the earth to pass cables, electric lines, or pipes. Typically, they are secured to the end of a drill string of drill pipe that is rotated, either from the surface or by a mud motor. Rotation of the bit and applied force (weight-on-bit or WOB) causes the cutting elements to engage and cut or disintegrate earthen formations to form a borehole. A drilling fluid (mud) may be supplied (or removed) through the drill string to cool and lubricate the bit and to remove formation cuttings to the surface.

Such bits may be of the fixed- or rolling-cutter variety. Modern fixed-cutter bits employ cutting elements formed of super-hard materials, such as polycrystalline diamond, cubic boron nitride, and the like. These bits are commonly called PDC (polycrystalline diamond cutter) bits. PDC bits cut earthen formations by shearing cuttings from the formation (much like a machine tool cuts metals and other materials) while rolling-cutter bits crush and disintegrate the formation. Because of this cutting action, PDC bits often achieve much higher formation penetration rates than rolling-cutter bits and require less-frequent replacement because of their mechanical simplicity, chiefly the lack of moving parts. Because of their cutting mechanics, PDC bits form larger cuttings than do rolling-cutter bits and these cuttings must be removed from the borehole to avoid interfering with the cutting action and penetration of the bit during drilling and also from interfering with extraction of the drill string from the borehole. Fixed-cutter bits may also employ cutters or cutting elements formed entirely of hard metals, such as sintered or cemented tungsten carbide and the like.

In some applications, the cutting size is too large for the drilling fluid system to easily remove. The completions process is the stage of the well development in which the well is prepared for production by perforating the production tubing, hydraulic fracturing, and removing any remaining equipment from the tubular such as hydraulic fracturing plugs. Reentry is the process of drilling into a previously completed wellbore to remove cement, float equipment, check valves, and any remaining equipment left in the wellbore or down-hole tubular so that the well can be extended. These are two examples of well-drilling processes where large cuttings can be difficult to remove and can inhibit the processes.

To avoid the problem of the large cuttings of fixed-cutter bits, rolling-cutter bits are often used instead, but have a reduced penetration rate, and the bit may need multiple replacements to finish the application. There has also been some success using fixed-cutter bits that are designed to produce small cuttings for these applications by several means such as using smaller cutting elements with low exposure and high blade count and by highly restricting the penetration rate, costing time and potential damage to production tubing, bore, and bit.

A need exists, therefore, for improvements in fixed-cutter bits where cutting size and removal is an issue and to generally improve fluid flow characteristics of such bits.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
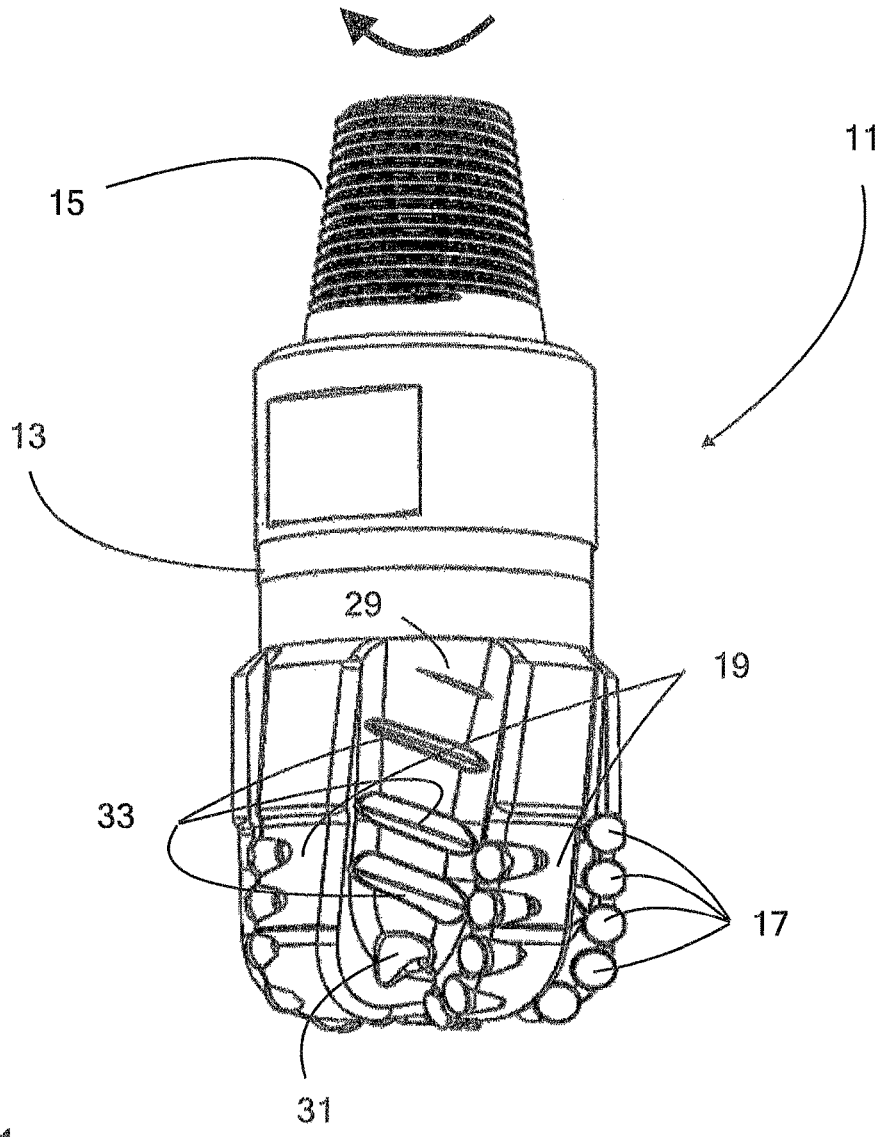
FIGS. 1 and 2 are perspective views of an earth-boring bit of the present application.

While the earth-boring bit of the present application is susceptible to various modifications and alternative forms, specific embodiments thereof have been shown by way of example in the drawings and are herein described in detail. It should be understood, however, that the description herein of specific embodiments is not intended to limit the present application to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the earth-boring bit of this application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
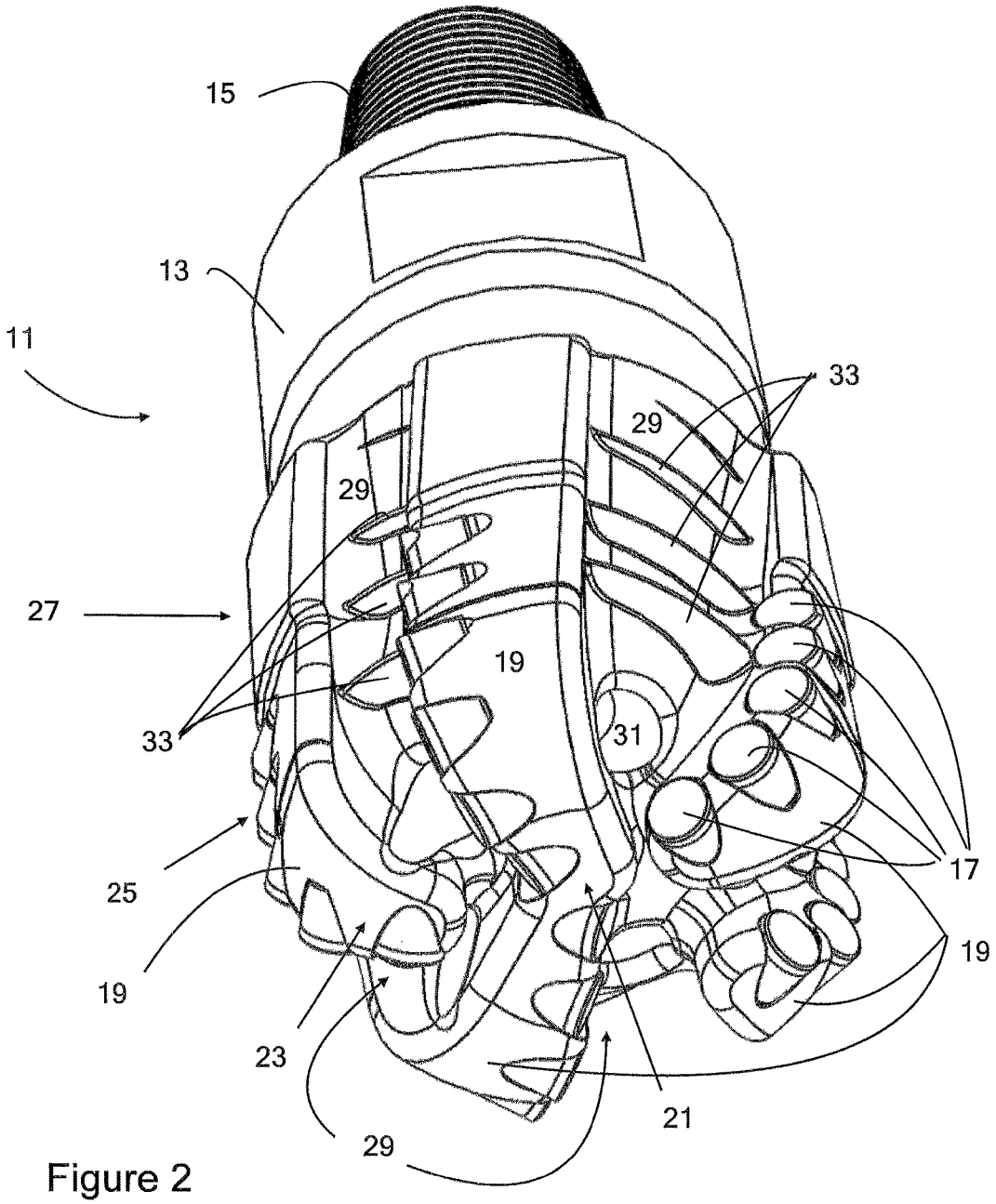

Referring to the Figures, FIGS. 1 and 2 illustrate an earth-boring bit 11 according to one embodiment of the present application. Bit 11, comprises a bit body 13, that typically includes a steel shank that is threaded at its upper extent 15 for connection into a drill string comprising multiple sections of drill pipe, or, in some cases, coiled tubing. At a lower end of bit body 13, there is a bit face that includes a plurality of cutting elements 17. The bit face portion of bit body 13 typically comprises a "matrix" material of sintered or infiltrated tungsten carbide particles that is cast or molded onto the steel shank. Cutting elements 17 have circular (or other shapes) cutting faces that are formed of polycrystalline diamond or other super-hard materials (natural diamond, cubic boron nitride and the like) mounted on a cemented (sintered with a binder) tungsten carbide stud or body. These studs or bodies are molded or brazed into the material of bit body 13 at selected locations so that the edges of the cutting faces of cutting elements 17 are presented to engage the formation to be drilled or bored as bit 11 rotates. The edges of cutting elements then shear cuttings (chips or fragments) of rock or earthen material from the formation being drilled, advancing the progress of the borehole.

Cutting elements 17 typically are arranged in rows or row-like arrangements on blades 19 formed on bit body 13. Each blade 19 has a leading edge (leading in the direction of rotation indicated by the bold arrow), on which cutting elements typically are mounted and a trailing edge that trails or follows the leading edge in the direction of rotation. Blades 19 converge at the center of the bit to define a "cone region" 21. A rounded "nose region" 23, which bears the brunt of the cutting action of bit 11, is defined radially outward from cone region 21. A "shoulder region" 25 is defined outward and upward from nose region 23. A smooth (no cutting elements) "gage region" 27 is defined at the uppermost end of the bit face at the full nominal diameter of bit 11. Shoulder region 25, with its active cutting elements, cuts and defines the diameter of the borehole being drilled, while the smooth gage pads in gage region 27 center bit 11 in the borehole. In some cases, the gage pads in gage region 27 are provided with active cutting elements and are not "smooth."

A junk slot or water way 29 is defined between each two adjacent blades 19. One or more nozzles 31 located in bit body 13 spray drilling fluid (commonly referred to as "drilling mud") from an interior of bit body 13 onto the borehole bottom and sides and the cutting structure of bit 11 to cool and lubricate bit 11 and to carry rock or formation cuttings away from cutting elements 17, through junk slots or water ways 29, and up the annulus between the exterior of the drill string, and the sidewall of the borehole, where they are returned to the surface. Nozzles 31 may be integrally formed in bit body 13, but more commonly are receptacles formed in bit body 13 and dimensioned to receive prefabricated nozzles of standardized external dimension (and varying orifice diameter) that are retained in the receptacles by snap rings, threads or other fastening means. Drilling hydraulics, including the flow of drilling fluid through nozzles 31 and junk slots 29 and over and around bit 11 can be a critical factor in achieving and sustaining high rates of penetration (ROP) of formation material.

The elements of bit 11 described above are entirely conventional and intended to describe a bit that exemplifies the fixed-cutter bit in which the embodiments of the present application are implemented. The features may be varied, added-to, or eliminated while remaining within the scope of the present application, which is intended to encompass fixed-cutter bits generally, including without limitation, PDC bits, natural diamond bits, matrix bits, steel-body bits, and the like.

Figure 3:
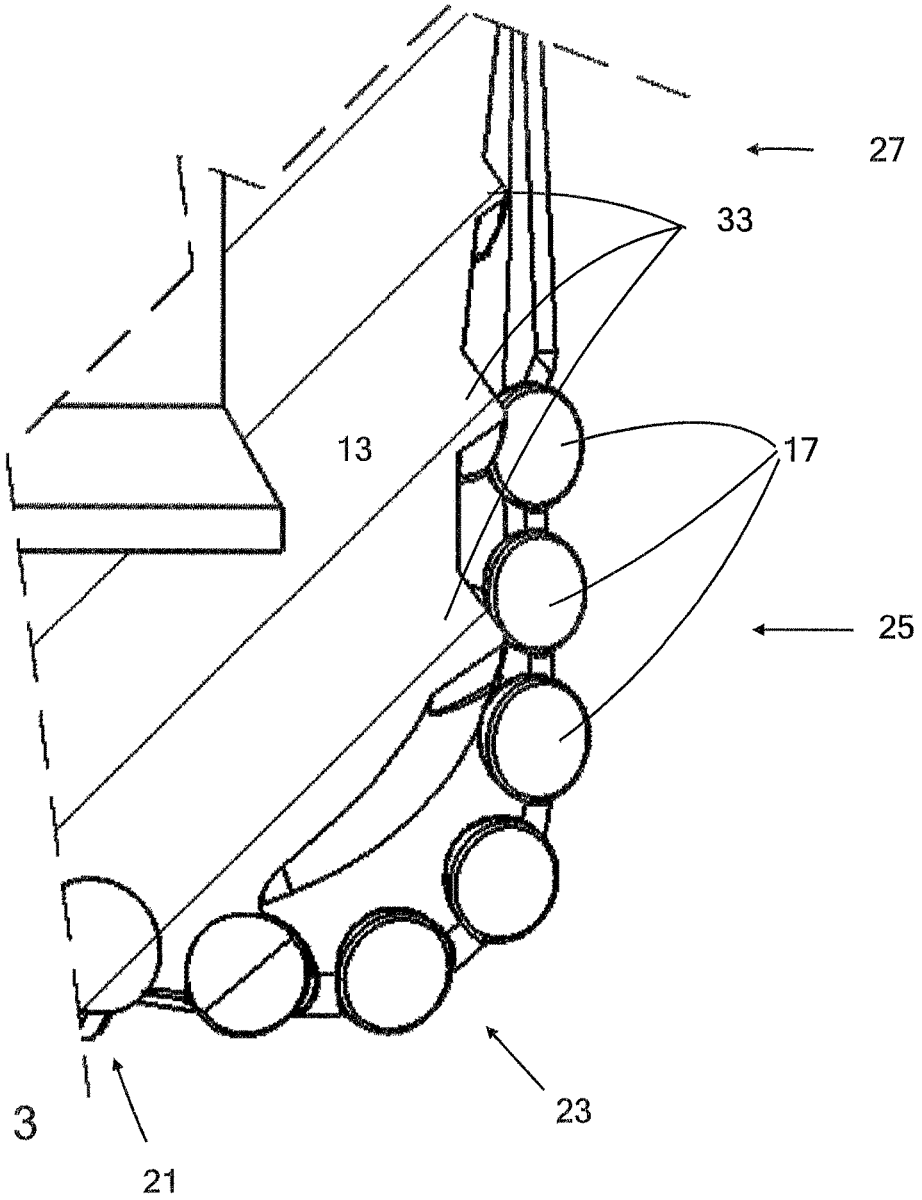
FIG. 3 is an enlarged fragmentary section view of a portion of the bit illustrated in FIGS. 1 and 2.

As mentioned, occasionally, the cuttings (chips or fragments) generated by the action of cutting elements 17 on formation material can be too large and it becomes desirable to further break up the cuttings (as used herein, "formation" and "formation material" and "cuttings" may refer to an earthen formation being drilled by a bit and the cuttings generated thereby, or to any other structures or materials found in a borehole or wellbore that may be drilled in other operations, such as composite formation plugs, or metallic downhole structures or tools and the cuttings generated thereby). According to an embodiment of the present application, at least one (illustratively three) milling elements 33 are provided in at least one, and preferably all, of junk slots 29. "Milling" is used herein in the sense of "milling grain into flour" or otherwise disintegrating or comminuting larger particles into smaller ones. Milling elements 33 may extend generally transversely across the entire width (or less than the entire width) of junk slot 29 through shoulder region 25 and the upper portion of nose region 32, as shown in FIGS. 1, 2, and 3. Milling elements 33 may extend upward or outward from a bottom surface of the junk slot 29 in which milling elements are located, but do not project as far outward as blades 19 and cutting elements 17, so that they may be considered recessed relative to these structures.

Figure 4:
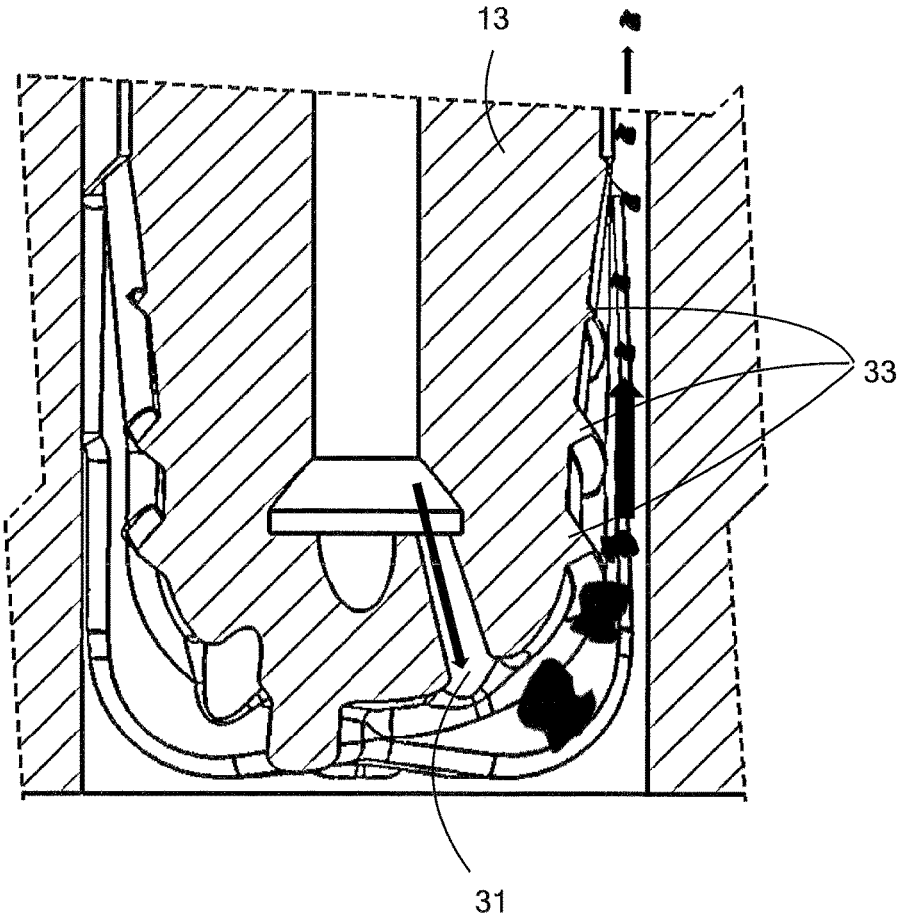
FIG. 4 is a longitudinal section view of the bit depicted in FIGS. 1 through 3, schematically illustrating the disintegration of large cuttings.

As indicated in FIG. 4, milling elements 33 retard or impede the upward progress of large cuttings until the cutting action of bit 11 either disintegrates them further to a size that will pass or shearing action between the outer edges of milling elements 33 and the sidewall of the borehole being drilled disintegrates the cuttings to a size that will pass. Accordingly, in a preferred embodiment of the present application, milling elements 33 are formed in a spiral helix about bit body 13 and extending across each junk slot 29 of bit 11. The helix is "pitched" so that each milling element 33 is angled downwardly with respect to the central axis of bit 11 as it extends from the trailing edge of one blade 19 to the leading edge of the adjacent blade 19. This orientation causes milling elements to direct cuttings downwardly and toward the cutting elements 17 of a blade 19 for further disintegration of the cuttings as the bit rotates. The angular orientation also induces a vertical component (in addition to the angular or rotational component) to relative motion between each milling element 33 and the sidewall of the borehole being drilled, which may further assist in disintegrating large cuttings. Thus, one or more milling elements 33 may intersect the longitudinal central axis of bit 11 at a selected angle ranging from 0 to 90 degrees or greater. As the angle of milling elements approaches 0 degrees (vertical), a larger number of, or wider, milling elements 33 may be required to prevent passage of large cuttings upwardly. Alternatively, combinations of milling elements of differing configuration (horizontal, vertical, staggered, wide, narrow, etc.) may be employed to prevent passage of cuttings upwardly.

In a preferred embodiment, milling elements 33 are continuous, uninterrupted ridges integrally formed or molded into the matrix or other material of bit body 13, as shown in FIGS. 3 and 4. They may be reinforced by hard metal (cemented tungsten carbide or similar) or even superhard material coatings (hardfacing) or inserts of the same shape as the milling elements. Alternatively, they could be formed as a single or multiple discrete inserts that are attached to bit body 13 in the same way as cutting elements 17. Preferably, milling elements 33 extend continuously across the entire width of each junk slot 29, as illustrated. However, they may also be interrupted or discontinuous or otherwise provided with small gaps that are not large enough to pass cuttings that are deemed too large. Milling elements 33 may also extend across less than the width of junk slots 29, but any gaps between the ends of milling elements 33 and the wall of junk slot 29 (or face of blade 19) should be small enough to prevent upward passage of cuttings deemed too large.

The bit embodiments of FIGS. 1 through 4 are concerned with the flow of solid cuttings or particles suspended in drilling fluid through the junk slots of the bit. FIGS. 5 through 9 are bit embodiments that concern themselves more with the flow of drilling fluid, with or without large suspended solids, through one or more of the junk slots of the bit. FIGS. 5 through 9 illustrate various surface treatments or textures 51, 53A, 53B, 55, 57, and 59 applied in the junk slots 21 of bits 11 that are otherwise generally as described in connection with FIGS. 1 and 2 (milling elements 33 are not illustrated for clarity, but may be used in connection with the disclosed surface textures). These surface textures or treatments serve to alter the flow of fluid through junk slot 21 in various ways.

Figure 5:
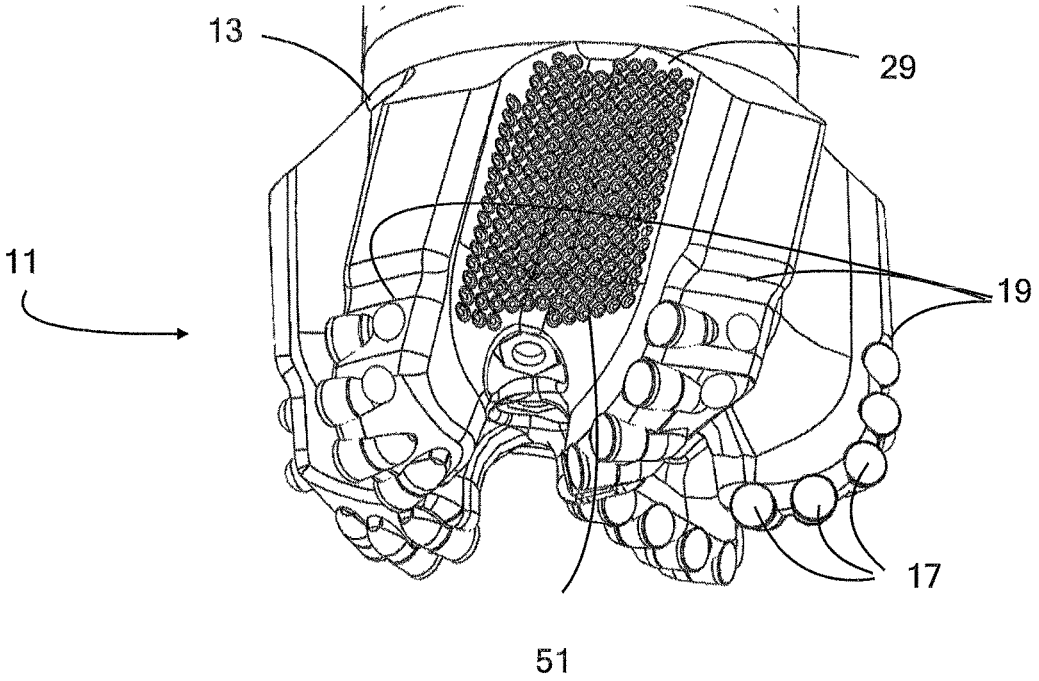
FIGS. 5 through 10 are perspective views of an earth-boring bit incorporating surface textures according to another embodiment of the present application.

FIG. 5 illustrates a surface texture or treatment 51 in junk slots 21 that comprises hemispherical or semispherical depressions or indentations arranged generally in "rows and columns." Each depression has a diameter of about 1 inch to 0.06 inch (and corresponding depth of between about 0.03 inch and 0.5 inch) and the depressions extend over the majority if not the entirety of the bottom surface of junk slot 21 and may extend at least partially onto the leading and trailing edges of blades 19 bordering junk slot 21. Spherical depressions 51 are symmetrical at the surface of junk slot 21 and are not intended to have a "directional" effect on fluid flowing through junk slot, rather they are intended to generate turbulence at least in the boundary layer, with each depression creating a pocket of stagnation. This turbulence may help prevent adhesion of formation material to the surfaces of the junk slots.

Figure 6:
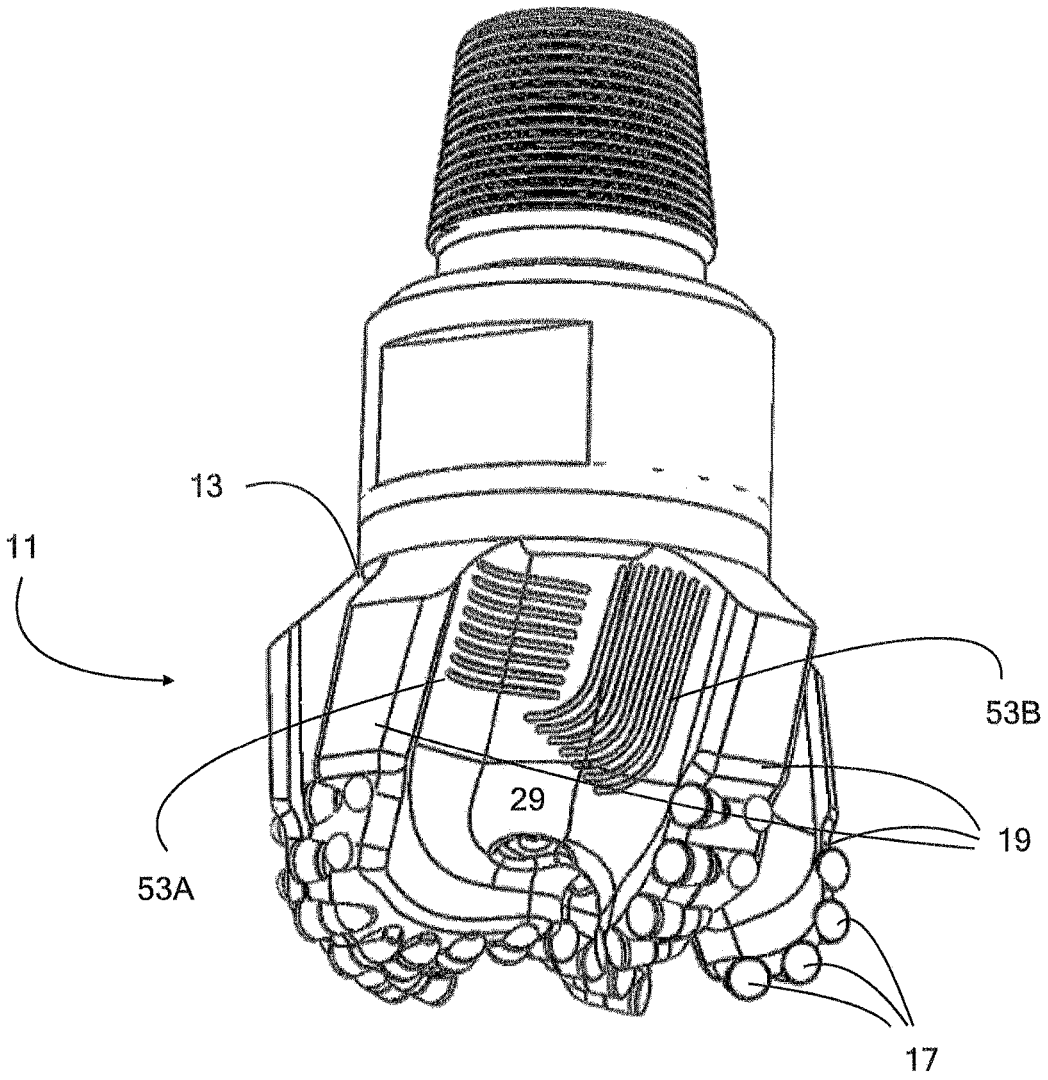

FIG. 6 depicts a "dual" surface texture comprising a series of substantially horizontal and parallel grooves 53A combined with a series of "J" grooves, also "parallel" with the long, straight portion oriented vertically. Each groove is about 0.03 inch deep, but may be as deep as one inch on a large-diameter bit or for specific applications. Grooves 53A are symmetrical about their longitudinal axes (axisymmetric), while J grooves 53B are asymmetrical. The substantially horizontal and parallel grooves 53A are intended to induce localized boundary layer turbulence in order move the predominantly laminar flow to another region of the junk slot 29. The J grooves 53B are intended to provide a differential-pressure bit-cleaning mechanism, where the groove, when covered with an adhesion or obstruction (bit balling or fouling, for example), allows for the increased pressure of the blocked or partially blocked junk slot 29 to communicate between the bit body 13 and the fouling causing a resultant force acting to push the fouling from the bit body 13.

Figure 7:
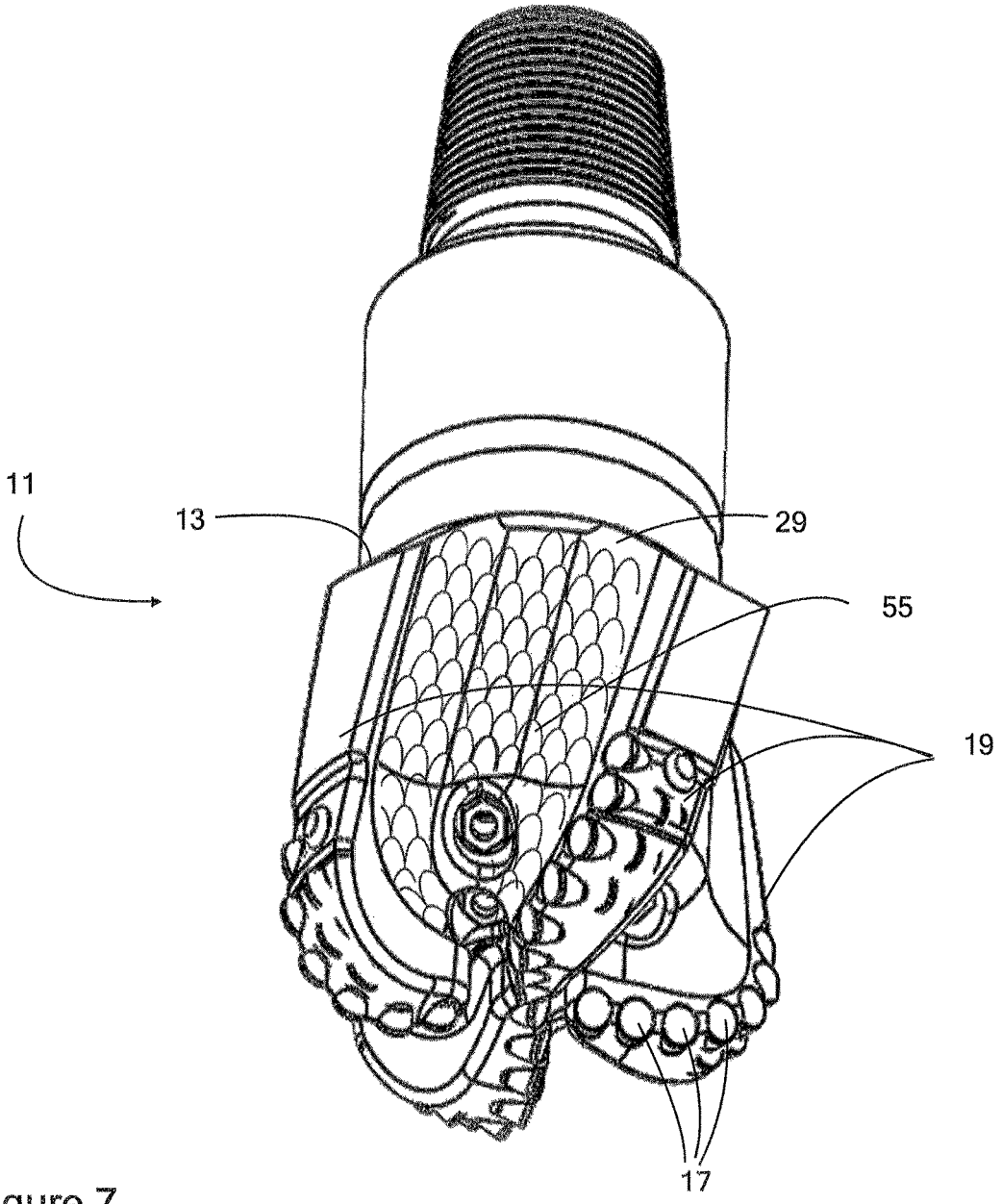
Figure 8:
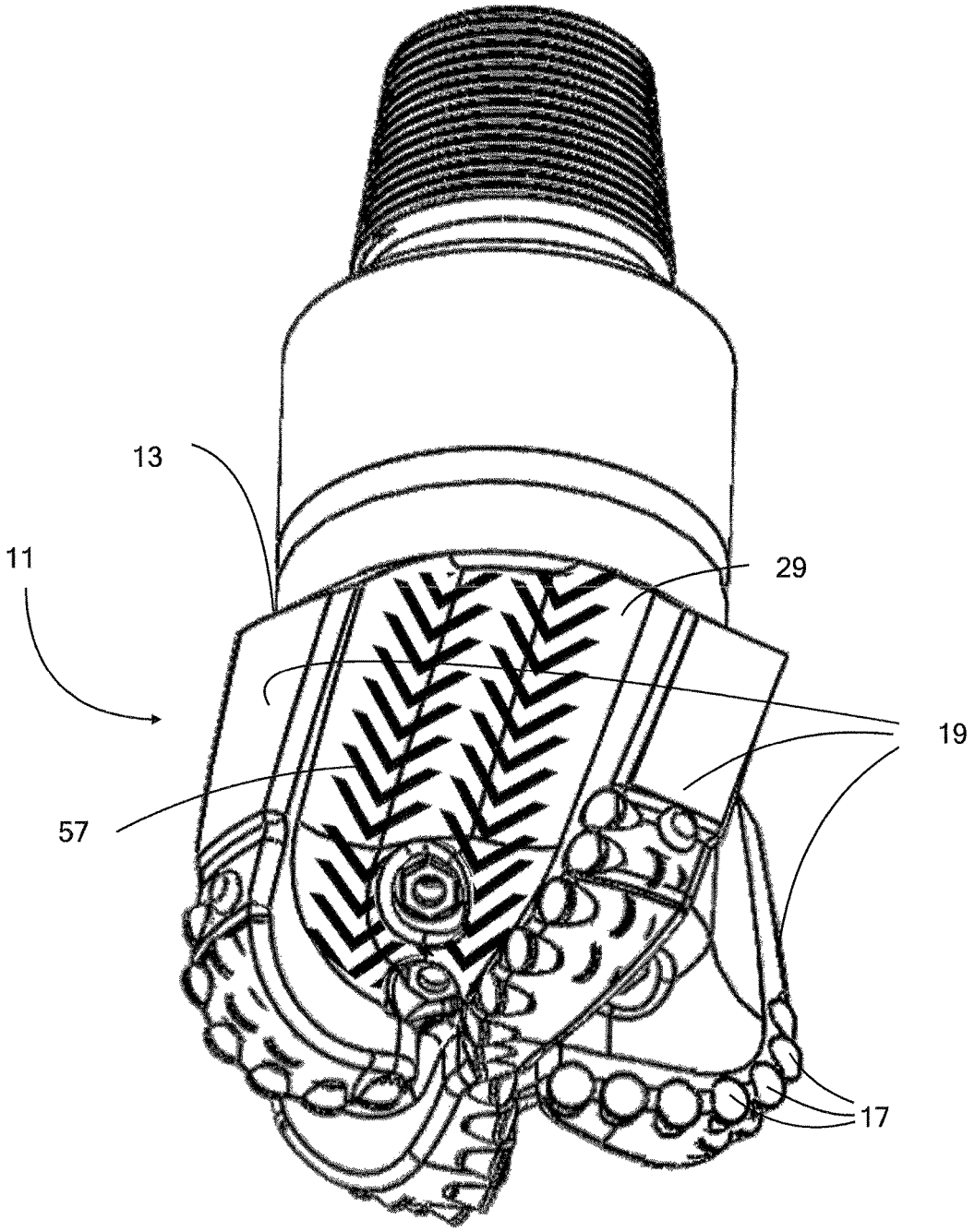
Figure 9:
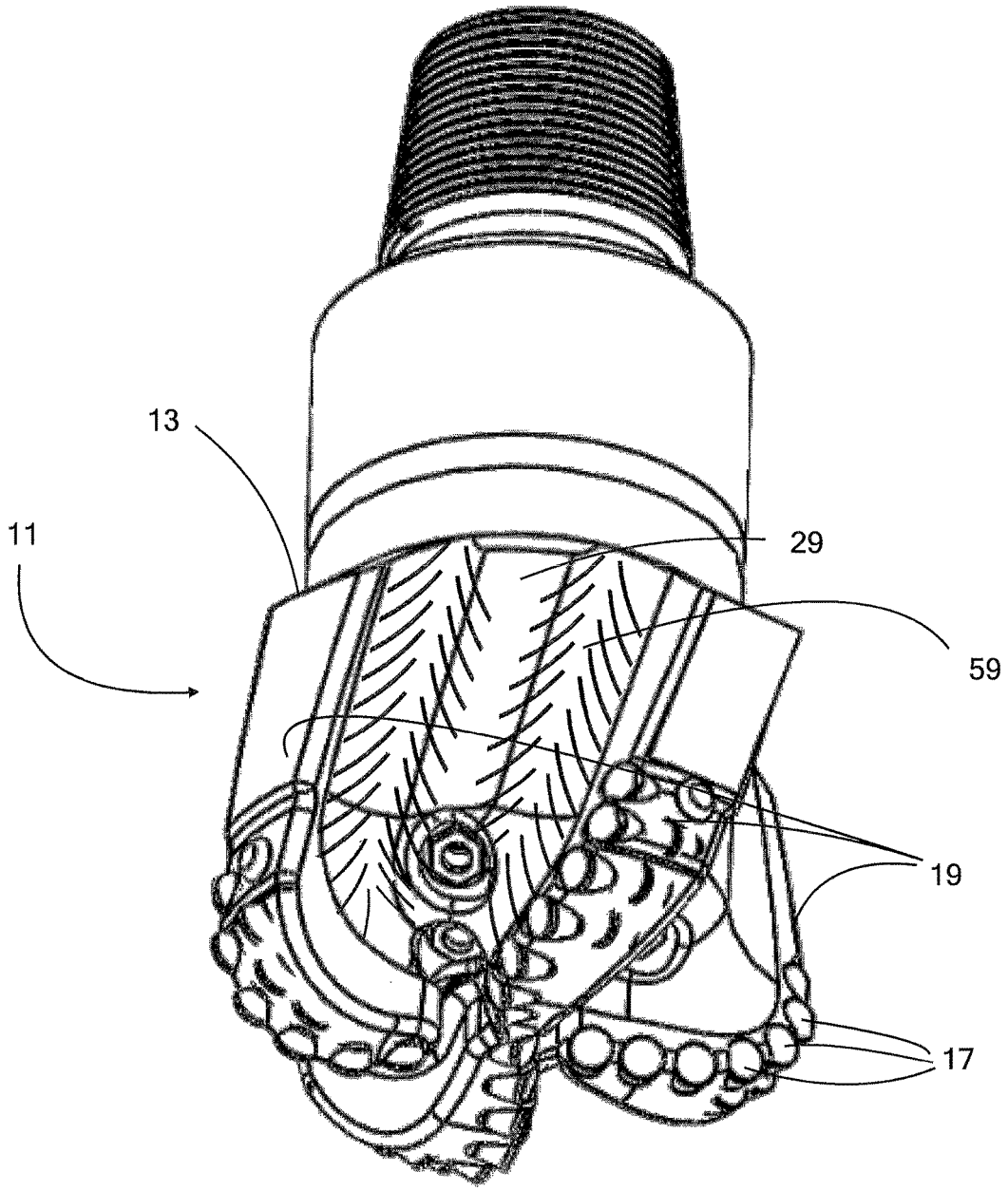

FIG. 7 illustrates a surface texture comprising "fish scale" grooves 55, More accurately a series of parabolic or hyperbolic curves with their apices oriented upwardly, symmetrical about their longitudinal axes, and with their longitudinal axes all parallel with one another. FIG. 8 depicts a surface texture comprising a plurality of triangular "chevron" grooves 57, with their apices pointed downwardly. FIG. 9 illustrates a surface texture comprising a plurality of "whiskers" 59 or curved segments converging toward one another without actually intersecting. Each groove in these patterns again is between about 0.03 and one inch in depth and width, depending on bit diameter or other parameters. None of these patterns can be considered symmetrical or axisymmetrical, but they have an axial or "directional" aspect. The various patterns cause localized turbulence in the boundary layer, which can act to prevent balling or fouling of the bit, and the grooves can act as a passage for differential pressure to communicate fluid under a junk slot obstruction or adhesion, causing a pressure difference that assists in removal of the obstruction or adhesion from the junk slot.

Figure 10:
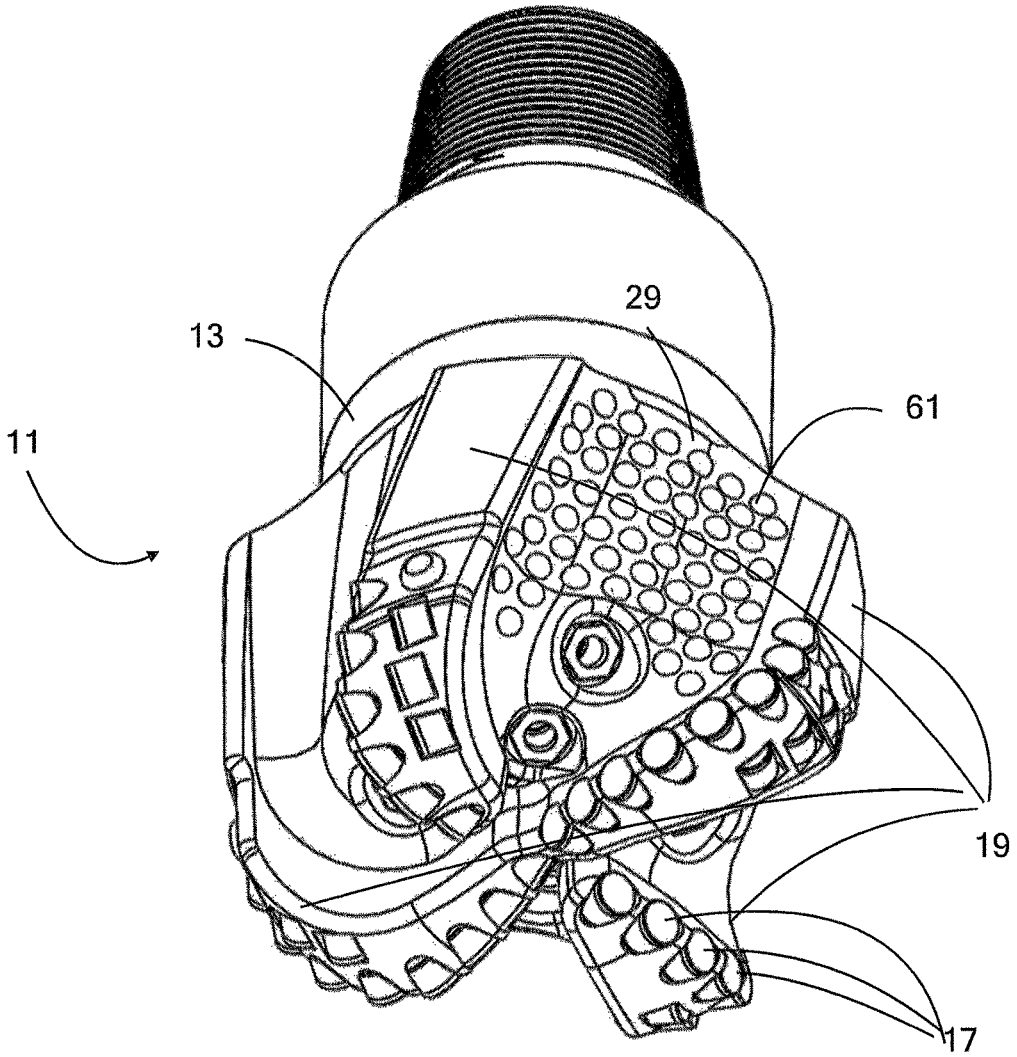

FIG. 10 illustrates a surface texture comprising a plurality of spherical or semi-spherical protrusions or elements 61. Each element 61 is raised relative to the bottom surface of junk slot and has a diameter of 0.03 inch up to 1 inch, and corresponding depth. It is the reverse, or inverse, or mirror image of texture 51 depicted in FIG. 5. This surface texture creates a localized (relative to the raised surrounding area of each protrusion 61) depression or indentation surrounding the protrusions 61. This depression has the same effect (turbulence in the boundary layer and pressure differential) as the dimples and grooves of FIGS. 5 through 9.

Similarly, raised ridges or protrusions of similar or identical shape could replace the grooves in the textures 53A, 53B, 55, 57, 59, of FIGS. 6 through 9. The localized depressions between the ridges or raised portions would have almost identical configuration to the raised portions; that is, they are depressed or indented in relation to the immediately surrounding area and accordingly function similarly to the dimples and grooves.

It is apparent that an earth-boring bit with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

We claim:

1. An earth-boring bit comprising:

a bit body threaded at its upper extent for connection to a drill string;

a plurality of blades on the bit body, each blade having a leading edge and a trailing edge;

a plurality of cutting elements arranged on the leading edge of each blade;

a junk slot defined between pairs of adjacent blades, the junk slot defining at least one surface;

at least one nozzle in the bit body, the nozzle spraying drilling fluid from an interior of the bit body; and a surface texture formed on the surface of the junk slot, the surface texture selected to alter a flow of drilling fluid through the junk slot;

wherein the surface texture comprises a plurality of depressions indented relative to surrounding portions of the junk slot; and wherein the depressions are at least partially spherical dimples.

2. The earth-boring bit of claim 1, wherein the surface texture comprises:

a plurality of protrusions, raised relative to a bottom surface of the junk slot.

3. The earth-boring bit of claim 1, wherein the depressions are symmetrical.

4. The earth-boring bit of claim 1, wherein the depressions are axisymmetrical and the depressions are aligned along their axes of symmetry.

5. The earth-boring bit of claim 1, where in the depressions are asymmetrical.

6. The earth-boring bit of claim 1, wherein a portion of the depressions are axisymmetrical and a portion of the depressions are asymmetrical.

7. An earth-boring bit comprising:

a bit body threaded at its upper extent for connection to a drill string;

a plurality of blades on the bit body, each blade having a leading edge and a trailing edge;

a plurality of cutting elements arranged on the leading edge of each blade;

a junk slot defined between pairs of adjacent blades; and at least one milling element extending at least partially across the junk slot between the trailing edge and leading edge of adjacent blades;

wherein flow of cuttings generated by the cutting elements is impeded until the cuttings are disintegrated to a selected size; and wherein the at least one milling element is formed integrally with the bit body.

8. The earth-boring bit of claim 7, wherein the at least one milling element further comprises:

a plurality of milling elements, each milling element extending generally transversely between the leading and trailing edges of adjacent blades, the milling elements arranged in the junk slot in at least a shoulder region of the bit face.

9. The earth-boring bit of claim 7, wherein each milling element comprises:

a continuous and uninterrupted ridge that is raised relative to surrounding portions of the junk slot.

10. The earth-boring bit of claim 7, wherein each milling element extends at a selected angle downwardly across the junk slot from the trailing edge of a blade to the leading edge of an adjacent blade, such that wherein cuttings are directed to the cutting elements on the leading edge of the adjacent blade.

11. An earth-boring bit comprising:

a bit body threaded at its upper extent for connection to a drill string;

a plurality of blades on the bit body, each blade having a leading edge and a trailing edge;

a plurality of cutting elements arranged on the leading edge of each blade;

a junk slot defined between pairs of adjacent blades; and a plurality of continuous, uninterrupted, and raised milling elements, extending at least partially across the junk slot between the trailing edge and leading edge of adjacent blades;

wherein flow of cuttings generated by the cutting elements is impeded until the cuttings are disintegrated to a selected size; and wherein the milling elements are formed integrally with the bit body.

12. The earth-boring bit of claim 11, wherein each milling element extends at a selected angle downwardly across the junk slot from the trailing edge of a blade to the leading edge of an adjacent blade, wherein such that cuttings are directed to the cutting elements on the leading edge of the adjacent blade.

* * * * *